US005400103A

United States Patent [19]

Nagaosa

[11] Patent Number: 5,400,103

[45] Date of Patent: Mar. 21, 1995

[54] SQUEEZE ROLLERS

[75] Inventor: Kazuo Nagaosa, Wakayama, Japan

[73] Assignee: Noritsu Koki Co., Ltd., Japan

[21] Appl. No.: 191,196

[22] Filed: Feb. 3, 1994

[30] Foreign Application Priority Data

Feb. 5, 1993 [JP] Japan ..... 5-008380 U

[51] Int. Cl.[6] ..... G03D 3/08

[52] U.S. Cl. ..... 354/320; 354/323

[58] Field of Search ..... 354/319–324; 226/190; 492/38, 18

[56] References Cited

U.S. PATENT DOCUMENTS 4,660,471 4/1987 Wright, Jr. et al. ..... 101/219

4,734,729 3/1988 Hertzel et al. ..... 354/304

*Primary Examiner*—D. Rutledge

*Attorney, Agent, or Firm*—Wenderoth, Lind & Ponack

[57] ABSTRACT

A squeeze roller assembly is made up of a plurality of pairs of squeeze rollers are that arranged in a row over a plurality of rows of photographic developing tanks for delivering photosensitive materials between the adjacent developing tanks. One roller of each pair of squeeze rollers has formed in its outer peripheral surface an annular groove for preventing correction values printed on a base surface of a photosensitive material from being transferred to the rollers. Each annular groove has a width different from the widths of the other annular grooves.

4 Claims, 4 Drawing Sheets

SQUEEZE ROLLERS

BACKGROUND OF THE INVENTION

This invention relates to squeeze rollers for use in a photosensitive material developing apparatus and more particularly to squeeze rollers for removing treating solutions from photographic paper while it is fed through a printing/developing apparatus.

A printed photosensitive material is dipped in each of the treating tanks in a printing/developing apparatus which are arranged in a row, raised out of the treating tank and sent to the next treating tank.

During its travel from one treating tank to the next, it passes between a plurality of pairs of squeeze rollers arranged over the adjacent treating tanks. The squeeze rollers serve to squeeze the paper and remove any treating solution stuck on the paper. Thus, before the paper is fed into the next tank, treating solutions are completely removed from the paper so that the solution in one tank will never mix with the solution in the next tank.

The squeeze rollers, which are essential components for a printing/developing apparatus for photosensitive materials, have one problem in that correction values printed on the base surface (back) of a photosensitive material, which indicate important data for the subsequent treating, such as finish printing and re-printing, may be transferred to the squeeze rollers.

Thus, it is .an ordinary practice to provide one of each pair of squeeze rollers which is opposite to the base surface of a photosensitive material with an annular groove to prevent the rollers from coming into contact with the correction values printed on the base surface.

Any treating solution stuck on such rollers tend to crystallize along the edges of the annular grooves. While no photosensitive material is fed between each pair of squeeze rollers, the treating solution that has crystallized on one roller with the annular groove will be transferred to the other roller, which has no annular groove and is adapted to be brought into contact with the emulsion surface of a photosensitive material, thereby leaving two annular lines of crystallized treating solution on the other roller. Such crystallized solution stuck on the other roller may cause increased irregularity in sensitization of the emulsion surface of a photosensitive material or produce scratches thereon.

Such phenomena occur because the annular grooves formed in those of the plurality of squeeze rollers that are brought into contact with the base surface of a photosensitive material are not only located at the same position with respect to the photosensitive material being fed, but they also have the same width. Thus, as shown in FIG. 5, scratches or irregularly sensitized portions are formed on an emulsion surface 21 of a photosensitive material 20 along two lines or strips 23 by the respective squeeze rollers. Since such lines or strips 23 are formed by a plurality of the rollers, they tend to stick out like a sore thumb.

SUMMARY OF THE INVENTION

An object of this invention is to provide squeeze rollers which obviate the above-described problems.

According to the present invention, there is provided a squeeze roller assembly for use in a photosensitive material developing apparatus comprising a plurality of pairs of squeeze rollers over a plurality of treating tanks for removing treating solution from photosensitive materials. One of each pair of squeeze rollers is formed, in an outer peripheral surface thereof, with an annular groove for preventing correction values printed on the base surface of a photosensitive material from being transferred to the other of each pair of squeeze rollers, and each annular groove has a width different from the widths of the other annular grooves.

One of each pair of squeeze rollers which is adapted to be brought into contact with the base surface of a photosensitive material has an annular groove in its outer peripheral surface, while the other roller, adapted to be brought into contact with the emulsion surface of a photosensitive material, has no such groove. Developing solutions stuck on one of the rollers having the annular groove tend to crystallize along the edges of the annular groove. When the supply of photosensitive material is stopped, such crystallized developing solution will be transferred to the other roller having a flat surface, leaving strips of crystallized solution on the flat surface of the other roller.

When a photosensitive material is fed through each pair of squeeze rollers in this state, the condensed and crystallized developing solution stuck on the flat surface of the squeeze roller will be transferred onto the emulsion surface of the photosensitive material, thereby locally sensitizing the emulsion surface. This will cause irregularity in the sensitization of the emulsion surface. Otherwise, such strips of crystallized solutions stuck on the roller may produce strips of scratches on the emulsion surface.

In order to prevent correction values printed on the base surface from being transferred to the squeeze rollers, it is essential to form annular grooves in the squeeze rollers to be brought into contact with the base surface. Thus, it is impossible to completely eliminate irregularly sensitized portions or scratches on the emulsion surface. But it is possible to disperse and thus obscure such irregularly sensitized portions or scratches if the annular grooves have different widths from one another, because with this arrangement the edges of the respective annular grooves come into contact with the photosensitive materials at different positions.

According to this invention, the annular grooves formed in the squeeze rollers, to prevent correction values from being transferred to the rollers, have different widths from one another. Thus, scratches or irregularly sensitized portions on the emulsion surface of a photosensitive material will never concentrate in a striped pattern. Rather, they are dispersed and obscured.

Further, the frontmost squeeze roller, having the narrowest annular groove, serves to press the sensitized portions formed by the edges of the annular grooves formed in the rear rollers. Thus, such sensitized portions can be further dispersed and obscured.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
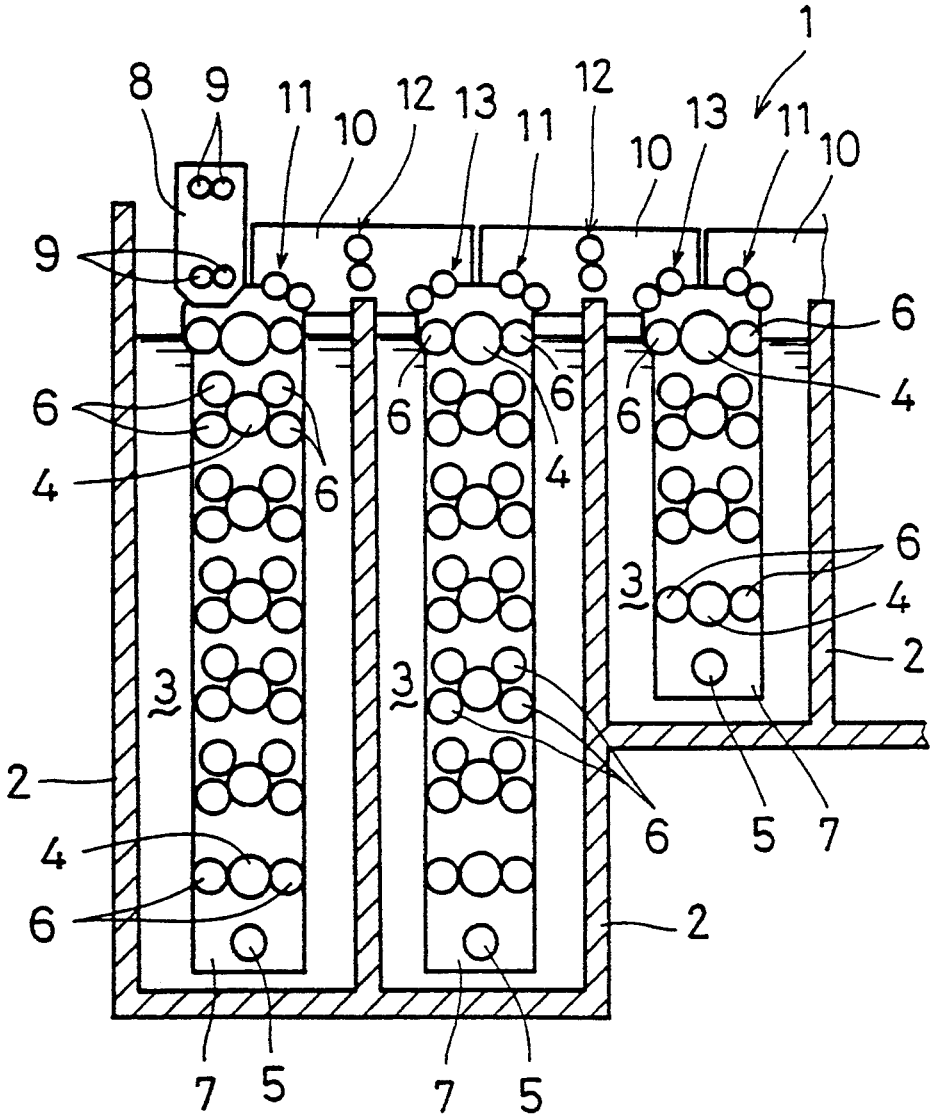
FIG. 1 is a schematic vertical sectional view of a portion of a photosensitive material developing apparatus having squeeze rollers embodying this invention.
Figure 2:
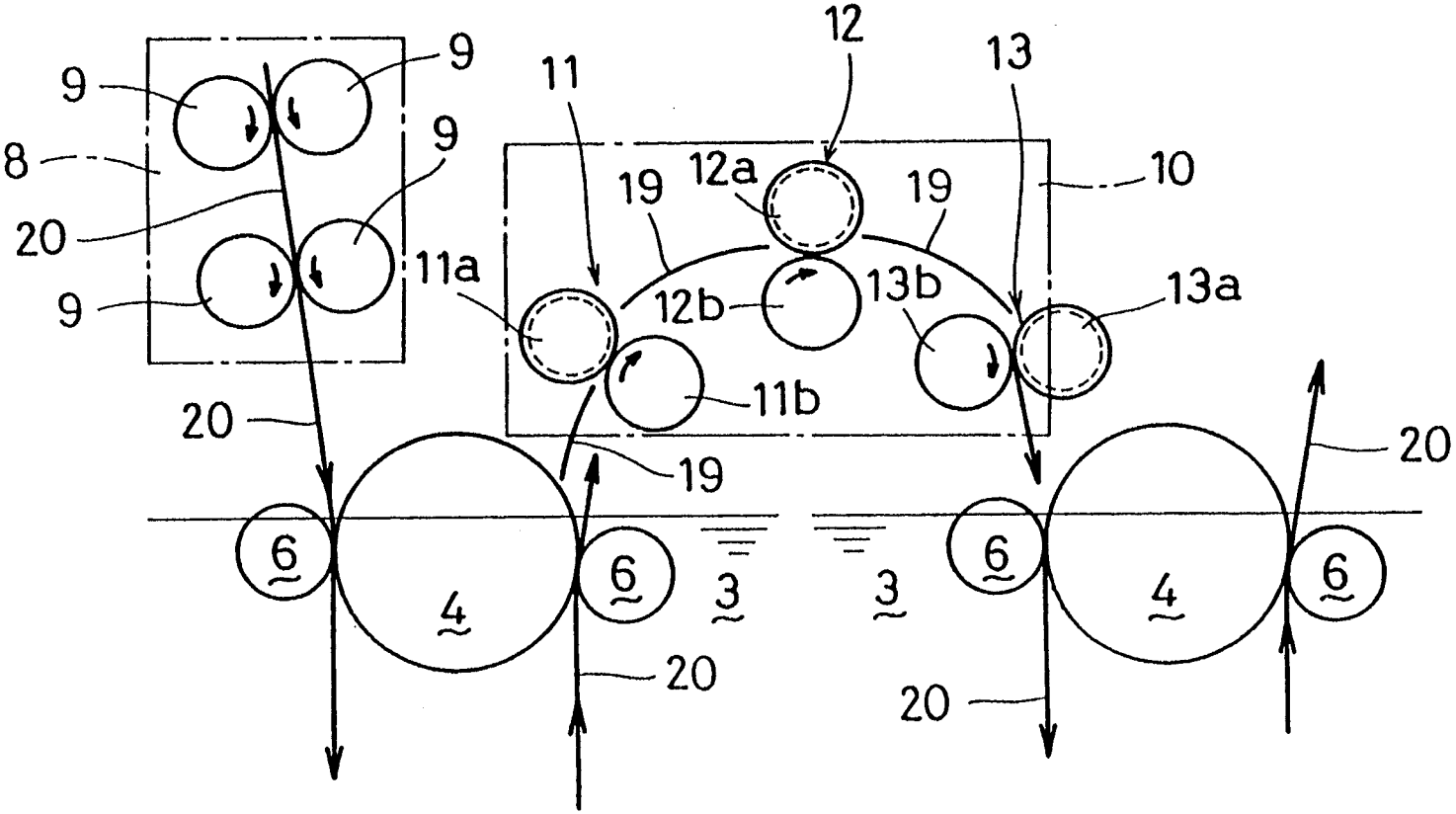
FIG. 2 is a schematic view showing how the squeeze rollers are mounted.

Referring to FIGS. 1 and 2, a printing/developing apparatus 1 has a plurality of treating tanks 2 arranged in parallel to one another and filled with different kinds of treating solutions 3. A rack 7 is immersed in each treating tank 2. It carries a plurality of vertically aligned center rollers 4, a turn roller 5 at its bottom, and side rollers 6 provided on both sides of the center rollers 4.

An insertion rack 8 carrying inlet rollers 9 is provided over a first treating tank 2 located at the left end in the figure. Also, over the treating tanks are provided overhead racks 10 bridging the adjacent tanks. Each rack 10 carries squeeze rollers 11, 12 and 13 made of a material which is resistant to attacks by the treating solutions, such as silicone rubber or teflon rubber (trade name), and arranged along a semicircular path of photosensitive material. Numerals 19 designate guides provided in the overhead racks 10 to guide the photosensitive materials into between the respective pairs of squeeze rollers.

After subjecting its emulsion surface 21 to printing treatment and printing on its base surface 22 correction values that indicate various data in terms of figures or letters, the photosensitive material 20 is fed through the inlet rollers 9 into the first treating tank 2. In the first tank 2, it is fed downwards between the center rollers 4 and the side rollers 6 on one side, turned 180° by the turn roller 5 and fed upwards. It is squeezed by the squeeze rollers 11, 12 and 13 and then is sent to the next treating tank 2.

The squeeze rollers 11, 12 and 13, which are provided over the adjacent treating tanks and which also serve as feed rollers, comprise pairs of rollers, i.e. rollers 11*a*, 12*a* and 13*a* adapted to come into contact with the base surface 22 of the photosensitive material 20 and rollers 11*b*, 12*b* and 13*b* adapted to come into contact with the emulsion surface 21.

Figure 3:
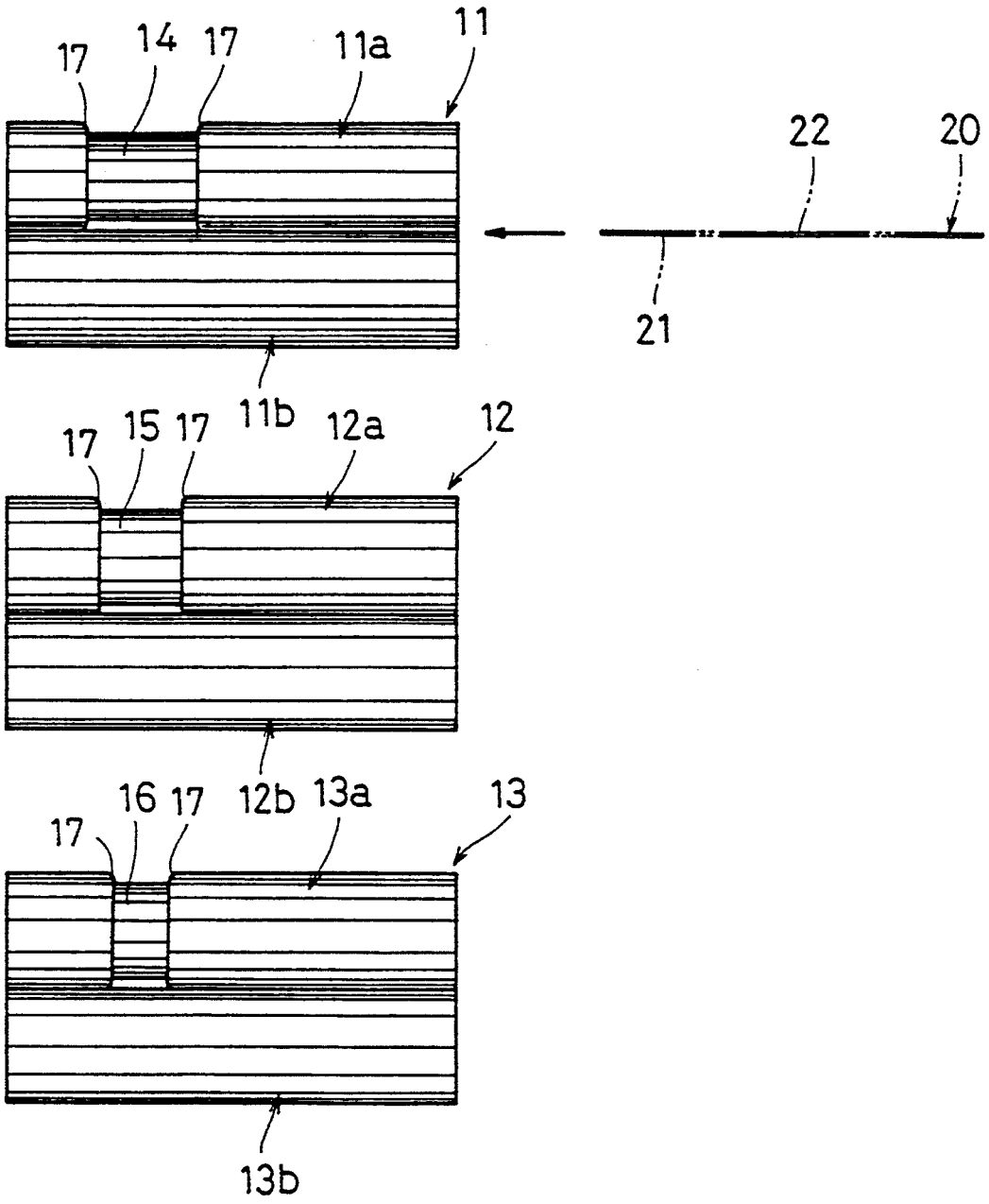
FIG. 3 is a side view of the squeeze rollers.
Figure 4:
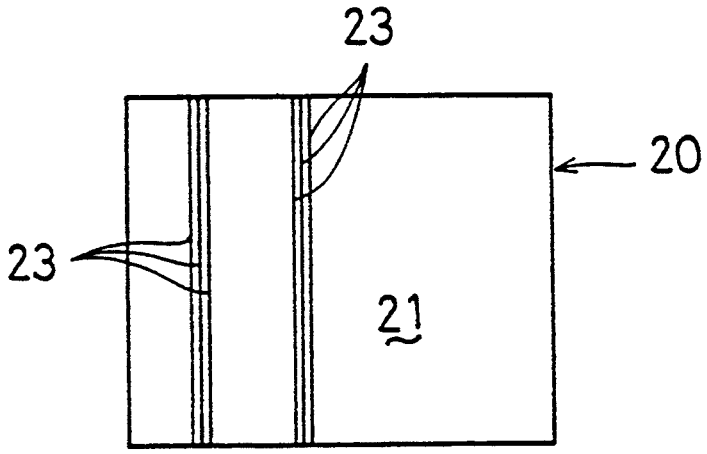
FIG. 4 is a plan view of an emulsion surface of a photosensitive material squeezed by the squeeze rollers according to this invention.
Figure 5:
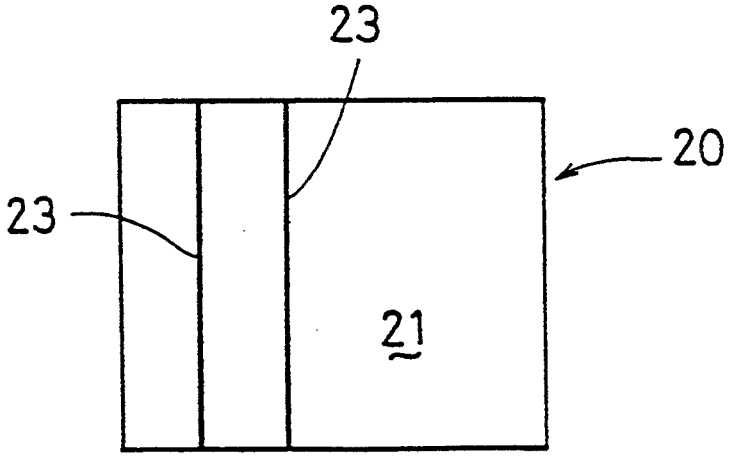
FIG. 5 PRIOR ART
FIG. 5 is a plan view of an emulsion surface of a photosensitive material squeezed by conventional squeeze rollers.

The rollers 11*a*, 12*a* and 13*a* are formed with annular grooves 14, 15 and 16 to prevent the transfer of the correction values printed on the base surface 22 of the photosensitive material 20 (FIG. 3). They have a depth of about 1.5 mm and are aligned with one another. Their widths are different from one another. For example, the annular grooves may have widths of 12, 10 and 8 mm, respectively, from rear to front with respect to the feed direction of the photosensitive materials. Of these grooves, the narrowest one 16 is of substantially the same width as the print width of the correction values.

In other words, the roller 11*a*, 12*a* and 13*a* have annular grooves of different widths from one another, with the frontmost roller (with respect the feed direction of the photosensitive material) having the narrowest groove.

Both edges 17 of each annular groove are rounded off with a small radius of curvature of about 0.5 mm. With this arrangement, treating solutions are less liable to crystallize along the edges 17, so that it is possible to disperse sensitized areas.

In the embodiment, a plurality of pairs of squeeze rollers are provided over and between two each adjacent treating tanks. But a single pair or squeeze rollers may be provided between each pair of adjacent tanks and one of the rollers may be formed with an annular groove having a varying width.

What is claimed is:

1. A squeeze roller assembly for use in photosensitive material developing apparatus, comprising a plurality of pairs of squeeze rollers over a plurality of treating tanks for removing treating solution from photosensitive material, one roller of each of said pairs of squeeze rollers being formed, in an outer peripheral surface thereof, with an annular groove for preventing correction values printed on the base surface of a photosensitive material from being transferred to the one roller of each of said pairs of squeeze rollers, and each annular groove having a width different from the widths of the other annular grooves.

2. A squeeze roller assembly as claimed in claim 1 wherein said annular groove formed in the one roller of one of said pairs of squeeze rollers located foremost with respect to the feed direction of photosensitive materials is the narrowest of all of said annular grooves.

3. A squeeze roller assembly as claimed in claim 1 wherein the widths of said annular grooves decrease from rear to front with respect to the feed direction of photosensitive materials.

4. A squeeze roller assembly as claimed in claim 1 wherein each said annular groove has its edges on both sides thereof rounded off with a predetermined radius of curvature.

* * * * *